US006981321B1

(12) United States Patent
Stoppek

(10) Patent No.: US 6,981,321 B1
(45) Date of Patent: Jan. 3, 2006

(54) HYDROSTATIC CYLINDER BLOCK AND METHOD OF MAKING THE SAME

(75) Inventor: Robert J. Stoppek, Mundelein, IL (US)

(73) Assignee: Sauer-Danfoss Inc., Ames, IA (US)

( * ) Notice: Subject to any disclaimer, the term of this patent is extended or adjusted under 35 U.S.C. 154(b) by 100 days.

(21) Appl. No.: 10/673,945

(22) Filed: Sep. 29, 2003

(51) Int. Cl.
*B23P 15/00* (2006.01)
*F01B 3/00* (2006.01)

(52) U.S. Cl. ..... 29/888.02; 92/71; 92/70; 92/57; 91/499

(58) Field of Classification Search ..... 29/888.02, 29/888.06; 92/71, 70, 57, 171.1; 91/499; 417/269

See application file for complete search history.

(56) References Cited

U.S. PATENT DOCUMENTS

| | | | | |
|---|---|---|---|---|
| 3,522,759 | A * | 8/1970 | Martin | 91/507 |
| 3,585,901 | A * | 6/1971 | Moon et al. | 91/6.5 |
| 3,955,475 | A * | 5/1976 | Horiuchi et al. | 91/499 |
| 5,655,432 | A * | 8/1997 | Wilkosz et al. | 92/71 |
| 6,322,474 | B1 * | 11/2001 | Hauser | 475/230 |
| 6,361,285 | B1 * | 3/2002 | Lehner | 417/269 |
| 6,575,079 | B2 * | 6/2003 | Lim et al. | 92/12.2 |
| 6,802,244 | B1 * | 10/2004 | Stoppek et al. | 92/71 |

* cited by examiner

*Primary Examiner*—Marc Jimenez

(57) ABSTRACT

A hydrostatic cylinder block having a split cylinder block with a slipper hold-down created by breaking down the cylinder block into its basic geometries through near net shaping technology. The cylinder block is broken down into four separate components: a hub, a wave spring, a cylinder block body, and a base plate. Each component is created using near net shaping technologies. The geometries are then placed together to create the completed cylinder block wherein the wave spring separates the hub from the block body to provide an improved slipper hold down force.

5 Claims, 5 Drawing Sheets

HYDROSTATIC CYLINDER BLOCK AND METHOD OF MAKING THE SAME

BACKGROUND OF THE INVENTION

This invention relates to the method of making a hydrostatic cylinder block. More specifically, and without limitation, this invention relates to a method of breaking a hydrostatic cylinder block down into its basic geometries and parts to produce a new and more efficient hydrostatic cylinder block manufacturing process.

In general, most hydrostatic cylinder blocks that are used in medium and heavy duty applications are produced by machining a single piece of raw material into its final shape. This manufacturing process is not only expensive but limits the function and the dimensional capability of the design. The high manufacturing costs stem from the numerous processing steps, high capital investment, and ongoing production costs. Cylinder block concepts that completely rely on machining to obtain net shape impose design limitations because of the inability to properly machine due to geometric constraints, (i.e., honing of cylinder block bores cylindrically, surface finish, and machine bore undercuts) causing production to be difficult and expensive.

The current process for a heavy duty hydraulic cylinder block is performed in ten separate operations. The manufacturer must first rough the turn block and drill bores for the cast-on-bronze process. Then the manufacturer must cast bronze on the bottom of the cylinder block. Next, in two separate operations, a manufacturer must turn the overall shape of the block. The next step is to ream the bushing bores. After reaming the bushing bores, kidneys must be milled into the bushing bores. Then the manufacturer has to press bushings in the bores and finish the machine bushing bores. Finally, one must broach the block splines and lap the cylinder block face onto the block, thus creating the heavy duty hydrostatic cylinder block.

The complex geometries and functional requirements of a cylinder block have typically forced manufacturers to resort to a large number of manufacturing operations. In general, today's cylinder block designs limit manufacturing to processes that are both costly and inefficient. To overcome the obstacle of a ten step process, a new concept has been conceived that breaks a standard cylinder block into basic geometries (components) that can be manufactured cost efficiently through various near net shaping technologies.

Near net shape processing achieves the final dimensions of a desired shape with minimal machining. Examples of near net shape technologies include casting, stamping, injection molding, and sheet metal working. For instance, in an injection molding process a mold of the dimensions needed for the construction of a metal product is created. Liquid metal is then injected into the mold and after some processes is cooled to create a machine part. This is called near net shaping because during the process the metal or material being used changes size and shape slightly during the cooling process. Therefore, near net shaping is not always perfectly accurate; however, because of recent advances in the near net shaping art, near net shaping is now precise enough to create hydrostatic cylinder blocks components of desired tolerances.

When machining hydrostatic cylinder blocks the machinery used to machine the blocks becomes worn, making maintaining dimensional tolerances very difficult. This exact machining takes a lot of time and can be very damaging to tools. Therefore, a process that would limit the amount of machining preformed on the block would greatly increase accuracy of tolerances and lower manufacturing costs.

Thus, it is a primary object of the present invention to provide a method for making a hydrostatic cylinder block with a split cylinder block with integrated slipper hold-down that improves upon the state of the art.

Another object of the present invention is to break a standard cylinder into its basic geometries that can be cost efficiently manufactured through various near net shaping processes.

Yet another object of the present invention is to manufacture a cylinder block that effectively transfers load and torque through the assembly.

A further object of the present invention is to integrate a slipper hold-down in the cylinder block to receive the benefits of keel and fixed clearance hold-down with fewer drawbacks to both.

These and other objects, features, or advantages of the present invention will become apparent from the specification and claims.

BRIEF SUMMARY OF THE INVENTION

The present invention is a method of making a hydrostatic cylinder block by breaking the cylinder block into its basic geometries and manufacturing the geometries using near net shaping technology. The hydrostatic cylinder block manufactured in the present invention is a split cylinder block with an integrated slipper hold-down. The hydrostatic cylinder block having a split cylinder block with an integrated slipper hold-down is manufactured by near net shaping a cylinder block body, a base plate, and a hub. When these components are combined with a wave spring that is placed in the bore of the cylinder block body in between the hub and the block body the hydrostatic cylinder block of the present invention is created. By using the geometries the ten-step operation of hydrostatic cylinder block manufacturing is now broken down into a three-step operation. First, a manufacturer must join the components. Then a manufacturer must hone the cylinder block bores and lap the cylinder block face onto the block. Thus, a heavy duty hydrostatic cylinder can now be manufactured more efficiently and more inexpensively.

DESCRIPTION OF THE EMBODIMENTS OF THE INVENTION

Figure 1:
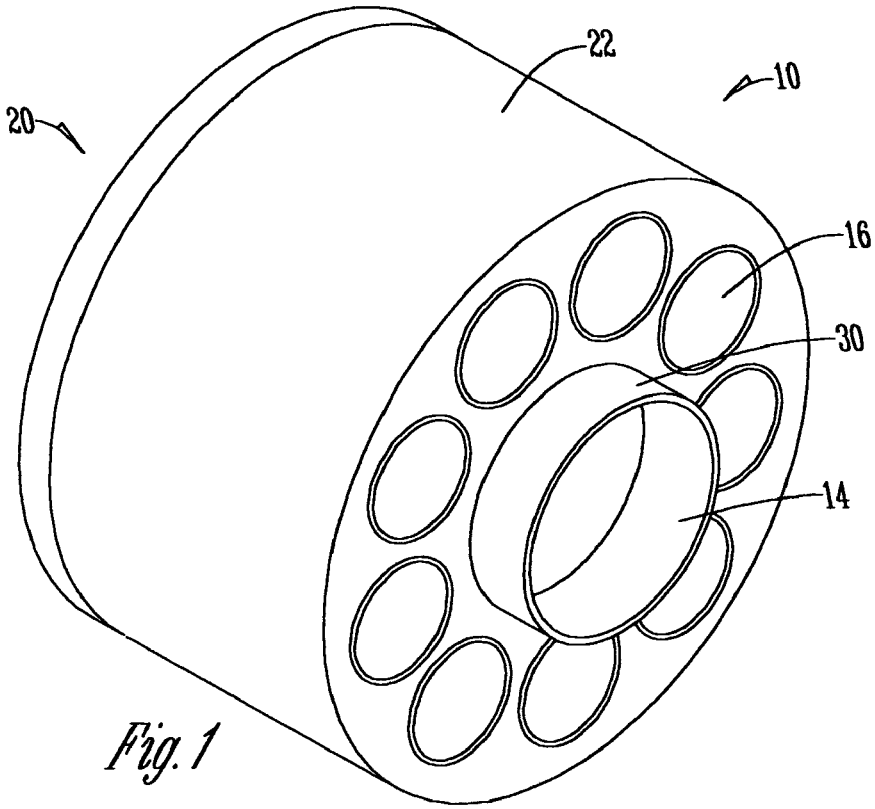
FIG. 1 is a top perspective view of the entire hydrostatic cylinder block.
Figure 2:
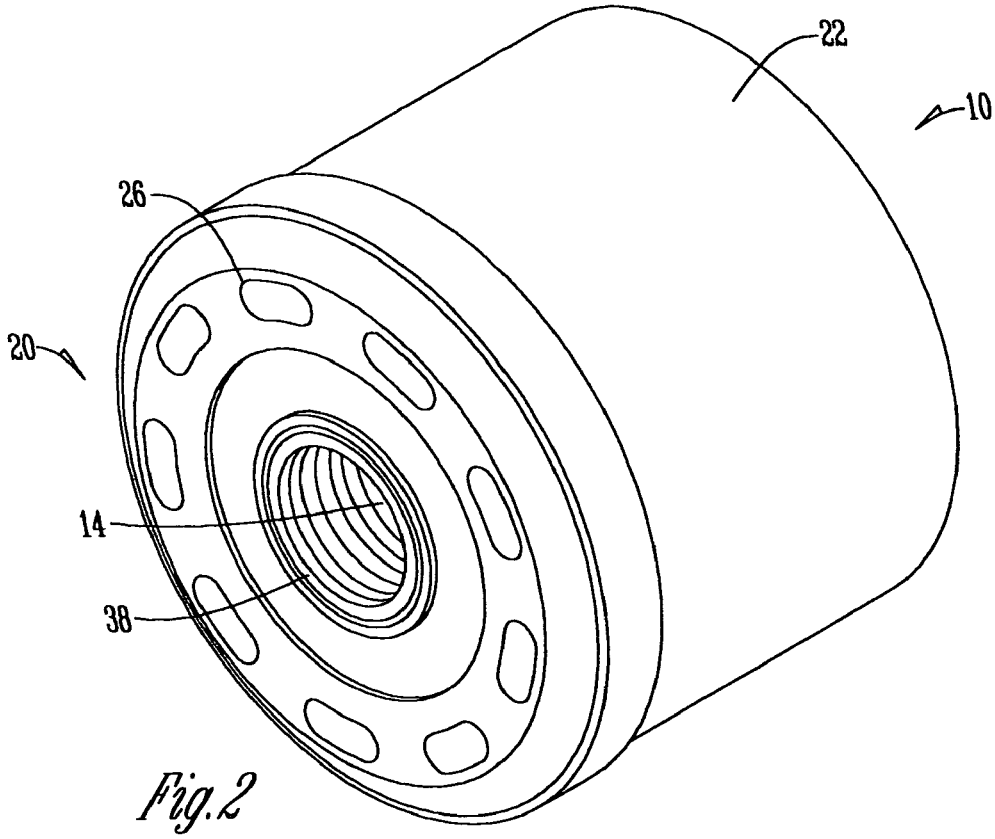
FIG. 2 is a bottom perspective view of the entire hydrostatic cylinder block.
Figure 3:
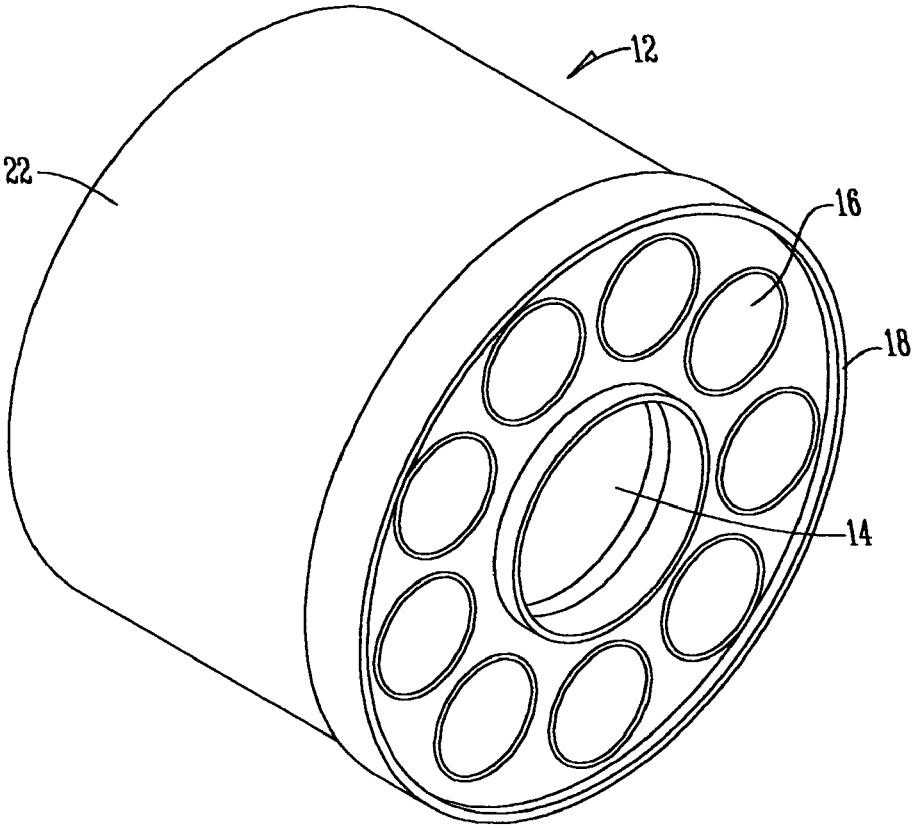
FIG. 3 is a perspective view of the cylinder block body of the hydrostatic cylinder block.

FIGS. 1 and 2 show a top and bottom view of the hydrostatic cylinder block 10 of this invention. Hydrostatic cylinder blocks are generally used in applications where large amounts of torque are needed. Such applications include in farm equipment, such as tractors, and in lawn tractors. The hydrostatic cylinder block 10 of the present invention is comprised of four separate components that can be seen in FIGS. 3–5. FIG. 3 shows the cylinder block body 12 of the hydrostatic cylinder block 10. The block body 12 has a cylindrical center bore 14 that is surrounded by a plurality of circular bores 16. The cylinder block body 12 also has a lip 18 for engaging the base plate 20. Circular sidewall 22 encases the cylindrical center bore 14 and circular bores 16 within the cylinder block body 12.

Figure 4:
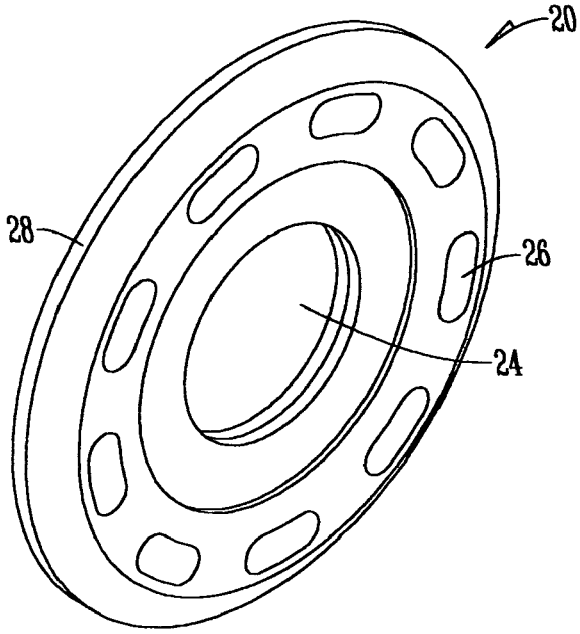
FIG. 4 is a perspective view of the base plate of the hydrostatic cylinder block.

As can be seen in FIG. 4, base plate 20 has a central opening 24 that matingly engages central opening 14 of the cylinder block body 12. Surrounding the central opening 24 of the base plate 20 is a plurality of kidney-shaped apertures 26 that are circularly arranged around the central opening 24. The base plate 20 also has a circular flange 28 that matingly engages the lip 18 of the cylinder block body 12.

Splitting the cylinder block 10 at the base allows both the base plate 20 and cylinder block body 12 to be manufactured through near net shaping technologies 3D to 2D shape. In addition, this allows the bores to be fine grounded, honed, or super finished, improving geometry and tribology. Through this processing improvement, an additional cost saving may be recognized if the bushings are eliminated. Because of the 2D body geometry, the block body 12 may be cost efficiently produced through near net shaping manufacturing technologies such as powder medal, lost foam, forging, stamping, or extrusion.

In the base plate 20 is the bottom portion of the cylinder block 12 with kidneys 24 and bores coinciding on the same pitch diameter. The annular projections around each of the bores facilitate the resistance welding process used to join the bores between the base plate 20 and block body 12. In a preferred embodiment, the base plate 12 is manufactured by a near net shaping process implementing powder metal.

Figure 5:
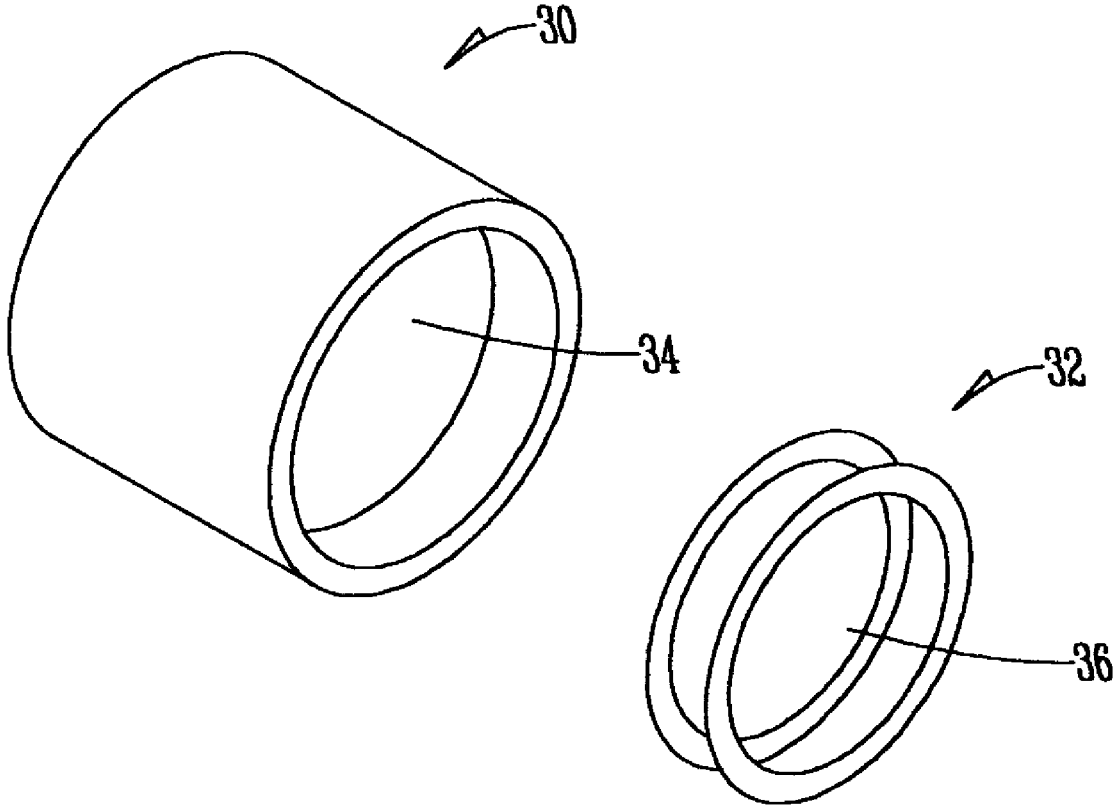
FIG. 5 is a perspective view of the hub and wave spring of the hydrostatic cylinder block.
Figure 6:
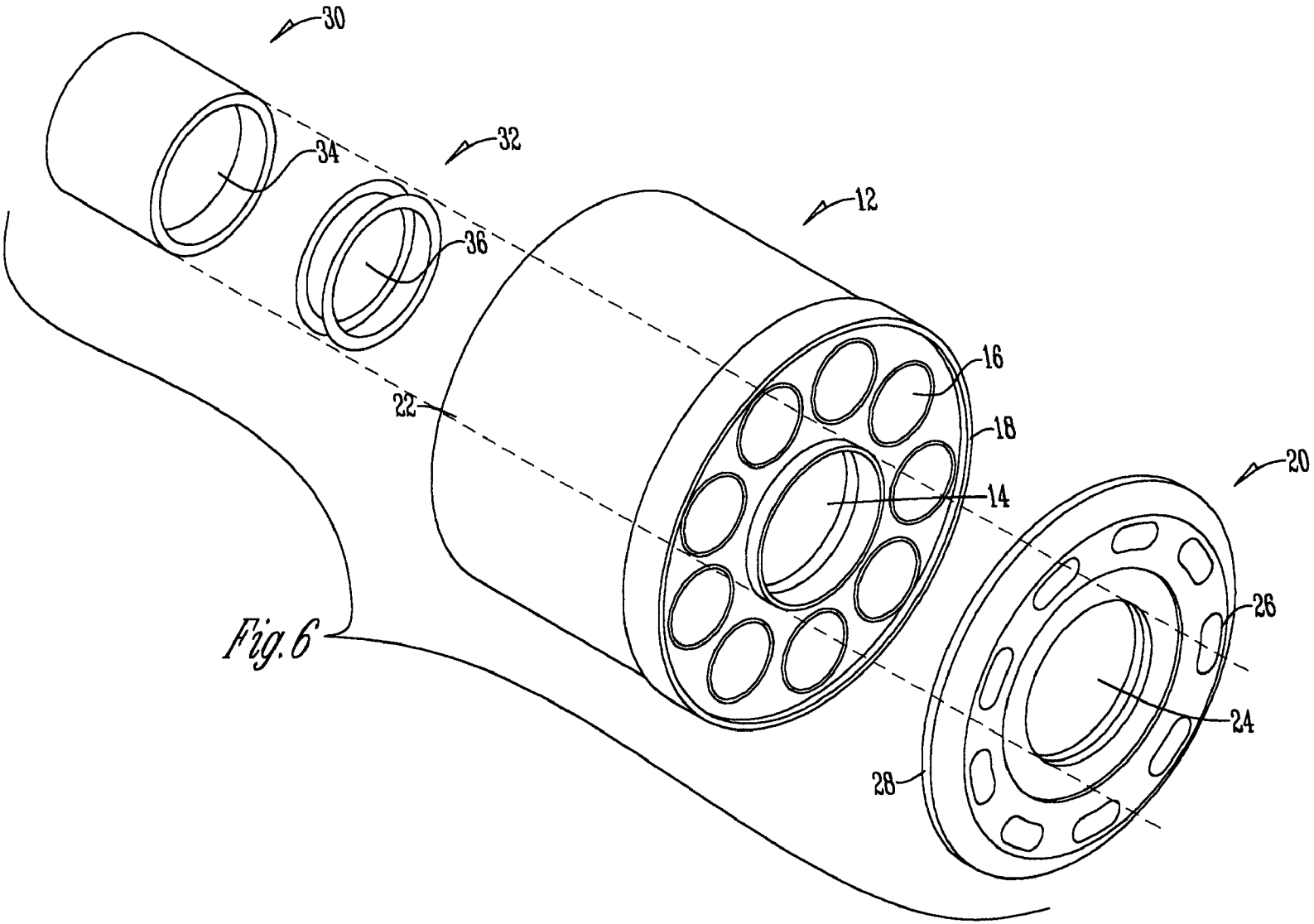
FIG. 6 is an exploded perspective view of the four parts separated with dash lines showing how each part meetingly fit together.
Figure 7:
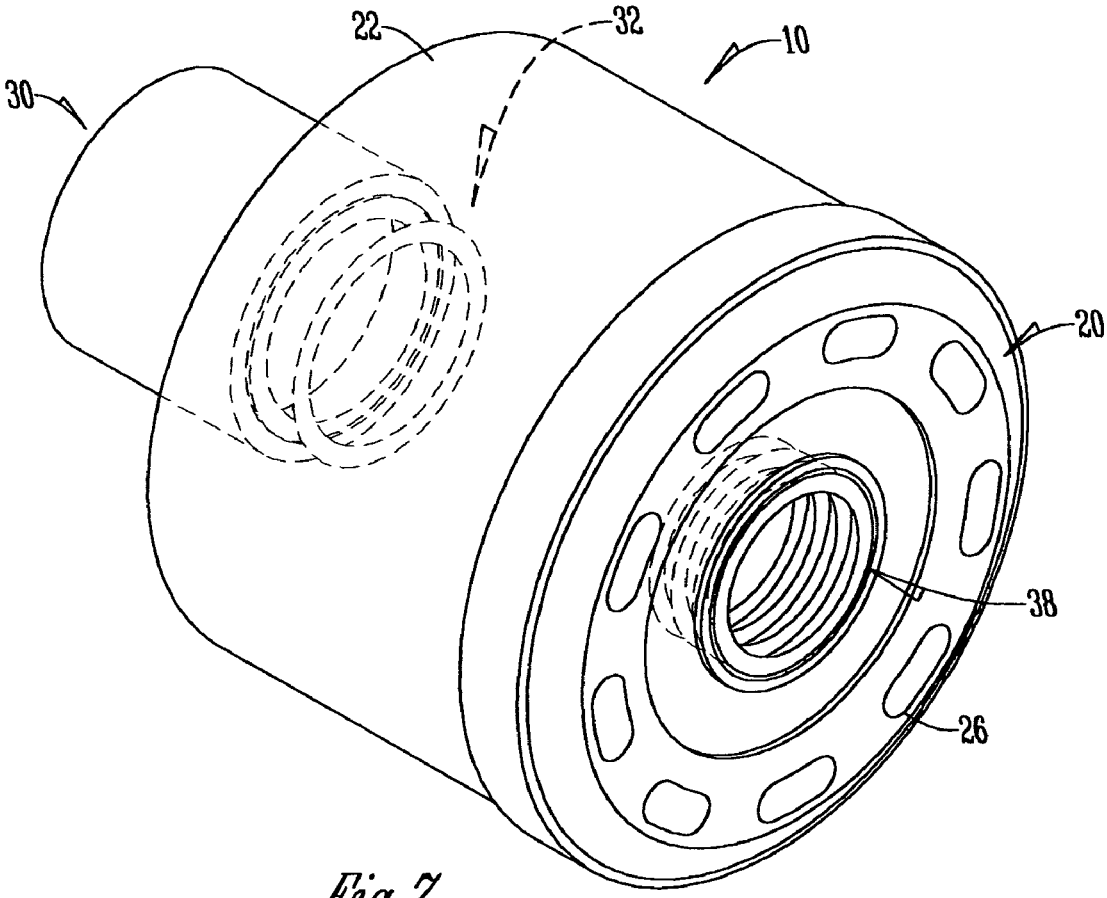
FIG. 7 is a perspective view of the entire hydrostatic cylinder block with hidden lines showing how the wave spring and hub are disposed within the cylinder block.

Referring now to FIG. 5 the final near net geometries include hub 30 and wave spring 32. Hub 30 has a central opening 34 that matingly aligns with the central opening 36 of the wave spring 32. As can be seen, this design positions the wave spring 32 between the cylinder block body 12 and the hub 30 to provide an improved slipper hold-down force over the typical hold-down force provided by a block spring 38 (FIG. 7). The design also separates the block body 12 from the hub 30 to insure proper loading that effectively maximizes efficiency and minimizes mechanical losses.

Therefore, the hub 30 and wave spring 32 design provides all the benefits of a keel and fixed clearance hold-down design and has fewer drawbacks. A keel design uses a block spring to provide the hold-down force for the slippers. Although the keel design insures slipper contact during low or no charge conditions, it significantly decreases mechanical efficiency because it relies on a large amount of block spring load. A fixed clearance design reduces the mechanical losses but increases slipper roll under low charge and/or high speed conditions. Improved fixed clearance devices reduce slipper roll under these conditions but are typically more expensive. Therefore the hub 30 and wave spring 32 arrangement improves upon the state of the art.

When the hydrostatic cylinder block 10 is in operation the hub 30 slidably moves in the cylindrical center bore 14 of the cylinder block body 12 to accommodate stack up variances during final assembly and to maintain a slipper hold-down force. The design is such that both hub 30 and block pilot on the shaft splines transmit torque. The hub 30 to block connection is a tight, slip fit to insure that hub forces are resolved. Other interlocking designs are possible, provided that free axial movement is permissible along the shaft centerline and the hub to block loads are resolved. A wave spring 32 is advantageous because the flat wire reduces spring solid height, allowing the lower operating heights while maintaining the same deflection and force that can be obtained with conventional round wire springs.

It will be appreciated by those skilled in the art that other various modifications could be made to the device without the parting from the spirit in scope of this invention. All such modifications and changes fall within the scope of the claims and are intended to be covered thereby.

What is claimed is:

1. A method of making a cylinder block for a rotatable hydrostatic power member, comprising steps of:

forming a base plate having a center opening with arcuate kidney-shaped uniformly spaced radially located bores and a flange;

forming a cylinder block having a center cylindrical bore, uniformly spaced radially located cylindrical bores having a smaller diameter than the center cylindrical bore, and a lip that extends into and mates with the flange of the base plate;

securing the base plate to the cylinder block along the lip and flange;

disposing a wave spring through the center cylindrical bore;

forming a hub and disposing the hub through the center cylindrical bore so that the hub is partially within the cylinder block.

2. The method of claim 1 wherein the base plate is formed by near net shaping technologies comprising one of powder metal, forging, stamping, lost foam, or extrusion.

3. The method of claim 2 wherein the cylinder block is formed by near net shaping technologies comprising one of powder metal, forging, stamping, lost foam, or extrusion.

4. The method of claim 2 wherein the hub is formed by near net shaping technologies comprising one of powder metal, forging, stamping, lost foam, or extrusion.

5. The method of claim 1 wherein the base plate is secured to the cylinder block using resistance welding.

* * * * *